US012270224B2

(12) United States Patent
Wu et al.

(10) Patent No.: US 12,270,224 B2
(45) **Date of Patent: *Apr. 8, 2025**

(54) POSTURE STABILIZING STRUCTURE FOR SWIMMING POOL SEWAGE SUCTION MACHINE

(71) Applicants: ZHEJIANG KUOCHUANG TECHNOLOGY CO., LTD., Zhejiang (CN); ZHEJIANG SAFUN INDUSTRIAL CO., LTD., Zhejiang (CN)

(72) Inventors: Changda Wu, Zhejiang (CN); Shurong Lv, Zhejiang (CN); Li Huang, Zhejiang (CN); Jiahao Huang, Zhejiang (CN); Yiheng Ying, Zhejiang (CN); Kuo Ying, Zhejiang (CN); Huifei Huang, Zhejiang (CN)

(73) Assignees: ZHEJIANG KUOCHUANG TECHNOLOGY CO., LTD., Yongkang (CN); ZHEJIANG SAFUN INDUSTRIAL CO., LTD., Yongkang (CN)

( * ) Notice: Subject to any disclaimer, the term of this patent is extended or adjusted under 35 U.S.C. 154(b) by 321 days.

This patent is subject to a terminal disclaimer.

(21) Appl. No.: 18/058,749

(22) Filed: Nov. 24, 2022

(65) Prior Publication Data

US 2023/0349187 A1 Nov. 2, 2023

(30) Foreign Application Priority Data

Apr. 28, 2022 (CN) ..... 202210469463.7

(51) Int. Cl.
*E04H 4/16* (2006.01)

(52) U.S. Cl.
CPC ..... *E04H 4/1654* (2013.01); *E04H 4/16* (2013.01); *E04H 4/1636* (2013.01)

(58) Field of Classification Search
CPC ..... E04H 4/16; E04H 4/1654; E04H 4/1636
See application file for complete search history.

(56) References Cited

U.S. PATENT DOCUMENTS

2023/0349186 A1* 11/2023 Wu et al.

* cited by examiner

*Primary Examiner* — Michael D Jennings
(74) *Attorney, Agent, or Firm* — Proi Intellectual Property US

(57) ABSTRACT

A posture stabilizing structure for a swimming pool sewage suction machine includes a base, a driving wheel assembly, a sealing box, a water pump assembly and a collecting box. The driving wheel assembly is connected to the base, the water pump assembly is arranged inside the base, the collecting box is arranged inside the base and communicated with the water pump assembly, and the sealing box is arranged on a middle part of a bottom of the base. The interior of the base is divided into an inner ring water distribution bin and an outer ring water distribution bin through the collecting box. A gas-liquid circulation hole is further defined in both a front end and a rear end of the bottom of the base and communicated with the outer ring water distribution bin.

12 Claims, 5 Drawing Sheets

POSTURE STABILIZING STRUCTURE FOR SWIMMING POOL SEWAGE SUCTION MACHINE

TECHNICAL FIELD

The present disclosure relates to swimming pool sewage suction machines, more particularly to a posture stabilizing structure for a swimming pool sewage suction machine.

BACKGROUND

Swimming pool sewage suction machine is a kind of machine that can be placed at the bottom of the swimming pool to clean dirt and the like on surfaces of the swimming pool. During the course of entering water, current swimming pool sewage suction machines will first float onto the water surface due to the influence of internal air of the swimming pool sewage suction machine, and then slowly sink as time goes on. During the course of sinking into water, the machine sometimes would get side overturned since heavy devices such as a driving wheel and a drive motor are arranged on one side of the machine. By the time, human labor is required to put the machine straight or hold the machine until it totally sinks into the water, not only consuming time, but also resulting in inconvenience for water entry. In addition, during the course of the swimming pool sewage suction machine walking underwater, since the bottom of the swimming pool is not completely flat, the machine would often hit bulges on the bottom while walking, which sometimes could cause great steering or side overturn of the machine and thus requires improvement.

SUMMARY

The present disclosure provides a new posture stabilizing structure for a swimming pool sewage suction machine, in view of the shortcomings in the existing technologies that the water entry course of the swimming pool sewage suction machine is both time consuming and labor consuming and furthermore the swimming pool sewage suction machine is easy to get side overturned during the courses of entering water and walking underwater as the center of gravity is on one side of the machine.

In order to resolve the above technical problems, the present disclosure is implemented through the following technical schemes.

A posture stabilizing structure for a swimming pool sewage suction machine includes a base, a driving wheel assembly, a sealing box, a water pump assembly and a collecting box, wherein the driving wheel assembly is connected to the base, the water pump assembly is arranged inside the base, the collecting box is arranged inside the base and communicated with the water pump assembly, and the swimming pool sewage suction machine has an X axis, a Y axis and a Z axis at a center along the length direction, width direction and height direction respectively, wherein the sealing box is arranged on a middle part of a bottom of the base, the interior of the base is divided into an inner ring water distribution bin and an outer ring water distribution bin through the collecting box, a gas-liquid circulation hole is further defined in both a front end and a rear end of the bottom of the base and communicated with the outer ring water distribution bin, a sewage inlet is further defined on the base at a position corresponding to the collecting box, a sewage suction opening corresponding to the sewage inlet is defined on a bottom of the collecting box, and the sewage suction opening is communicated with the inner ring water distribution bin.

The sealing box is arranged on the middle part of the bottom of the base, which can anchor the position of the center of gravity of the whole swimming pool sewage suction machine and improve the balance of the swimming pool sewage suction machine in entering water and walking underwater. The gas-liquid circulation holes are communicated with the outer ring water distribution bin, the sewage inlet and the sewage suction opening are communicated with the inner ring water distribution bin, enabling air and water currents to rapidly enter interiors of the outer ring water distribution bin and the inner ring water distribution bin through such parts during the course of the swimming pool sewage suction machine entering water and subsequently flow out through gaps on the base or the water pump assembly, and preventing air being covered to form a reacting force during the course of the swimming pool sewage suction machine entering water; consequently, not only the speed of the swimming pool sewage suction machine to enter water can be accelerated, but also the posture of the swimming pool sewage suction machine in entering water can be automatically stabilized, so that the machine can keep balanced.

Preferably, in the above posture stabilizing structure for the swimming pool sewage suction machine, a ratio of a sectional area of the sewage suction opening to a sectional area of the gas-liquid circulation hole is 1.2:1~1.8:1.

The sectional area of the sewage suction opening is greater than the sectional area of the gas-liquid circulation hole so that the volume of air and water entering the sewage suction opening is greater than that entering the gas-liquid circulation hole during the course of the swimming pool sewage suction machine entering water, that is to say, the volume entering the inner ring water distribution bin is greater than that entering the outer ring water distribution bin, further enhancing the center anchoring effect of the gravity center of the whole swimming pool sewage suction machine and improving the stability of posture of the swimming pool sewage suction machine.

Preferably, in the above posture stabilizing structure for the swimming pool sewage suction machine, a diversion bin is further provided on the base at the gas-liquid circulation hole.

The gas-liquid circulation hole is provided with the diversion bin so that air or water currents can enter the gas-liquid circulation hole more smoothly.

Preferably, in the above posture stabilizing structure for the swimming pool sewage suction machine, the diversion bin is in the shape of a cover body with an opening downward and the projection of the diversion bin in the height direction of the swimming pool sewage suction machine is on the X axis.

The projection of the diversion bin in the height direction of the swimming pool sewage suction machine is on the X axis, which enables the swimming pool sewage suction machine to keep a better stability and balance during the operation of the swimming pool sewage suction machine. The cover body with an opening downward on one hand can reduce the influence of cross currents on the gas-liquid circulation hole during the underwater walking course, and on the other hand can better guide and gather air or water currents during the water entry course to accelerate the water entry speed.

Preferably, in the above posture stabilizing structure for the swimming pool sewage suction machine, the gas-liquid circulation holes are distributed on the diversion bin in an annular array.

The gas-liquid circulation holes are distributed on the diversion bin in an annular array, so that the swimming pool sewage suction machine can better enter water during the water entry course, improving the smoothness of water entry.

Preferably, in the above posture stabilizing structure for the swimming pool sewage suction machine, the water pump assembly is connected to a middle part of an upper surface of the sealing box, the inner ring water distribution bin is annular, and a middle part of the collecting box is provided with an up-down through annular docking base, through which the collecting box is sleeved on the water pump assembly.

The water pump assembly is positioned at the middle part of the sealing box, further improving the gravity center anchoring function of the sealing box. The annular inner ring water distribution bin enables water currents to flow in a circle inside the inner ring water distribution bin, further enhancing the stabilizing effect of the inner ring water distribution bin on the swimming pool sewage suction machine. The arrangement of the annular docking base can improve the tightness between the collecting box and the water pump assembly.

Preferably, in the above posture stabilizing structure for the swimming pool sewage suction machine, the collecting box is provided to be symmetrical with the X axis and Y axis as center lines.

Through the above structure, the balance of the swimming pool sewage suction machine can be better kept.

Preferably, in the above posture stabilizing structure for the swimming pool sewage suction machine, a counterweight is further arranged inside the sealing box and the counterweight is provided to be symmetrical in front and rear with the Y axis as a center line.

The counterweight can increase the weight of the machine, facilitating the swimming pool sewage suction machine to better enter water and walk underwater. The counterweight is provided to be symmetrical in front and rear with the Y axis as a center line so that the balance of the swimming pool sewage suction machine can be better kept.

Preferably, the above posture stabilizing structure for the swimming pool sewage suction machine further includes a universal wheel, wherein the number of the universal wheel is two and they are connected to the front end and the rear end of the bottom of the base respectively, the projection of the universal wheel in the height direction of the swimming pool sewage suction machine is on the X axis, there are two driving wheel assemblies and they are connected to middle parts of left and right side surfaces of the sealing box respectively, and the projection of the driving wheel assembly in the height direction of the swimming pool sewage suction machine is on the Y axis.

The universal wheel holds responsibility for steering, the driving wheel assembly is configured to drive the swimming pool sewage suction machine to walk, the driving wheel assemblies are connected to middle parts of left and right side surfaces of the sealing box so that the gravity center anchoring function of the sealing box can be further enhanced. The universal wheel is positioned on the X axis and the driving wheel assembly is positioned on the Y axis, forming a cross layout of wheels that further enhances the stability of the swimming pool sewage suction machine during the walking course.

Preferably, in the above posture stabilizing structure for the swimming pool sewage suction machine, a distance between a center of the universal wheel and a center plane of the sealing box is 120 mm-200 mm.

Within the above distance range, not only the universal wheel is easy to steer, but also the stability of the swimming pool sewage suction machine can be well maintained.

Preferably, in the above posture stabilizing structure for the swimming pool sewage suction machine, the sealing box is positioned at an intersection of the X axis, the Y axis and the Z axis.

Through the above structure, the center and the gravity center of the swimming pool sewage suction machine can tend to be consistent, to better improve the balance of the swimming pool sewage suction machine.

Preferably, in the above posture stabilizing structure for the swimming pool sewage suction machine, the driving wheel assembly includes a drive motor and a wheel, and a surface of the wheel is provided with rigid rubber and soft rubber from inside out in turn.

The arrangement of the hard rubber and the soft rubber further enhances the traction of the wheel during the rotation of the wheel.

DETAILED DESCRIPTION

The present disclosure is described below in further detail in conjunction with accompanying drawings and specific embodiments, which, however, do not form limitation on the present disclosure.

Embodiment 1

Figure 1:
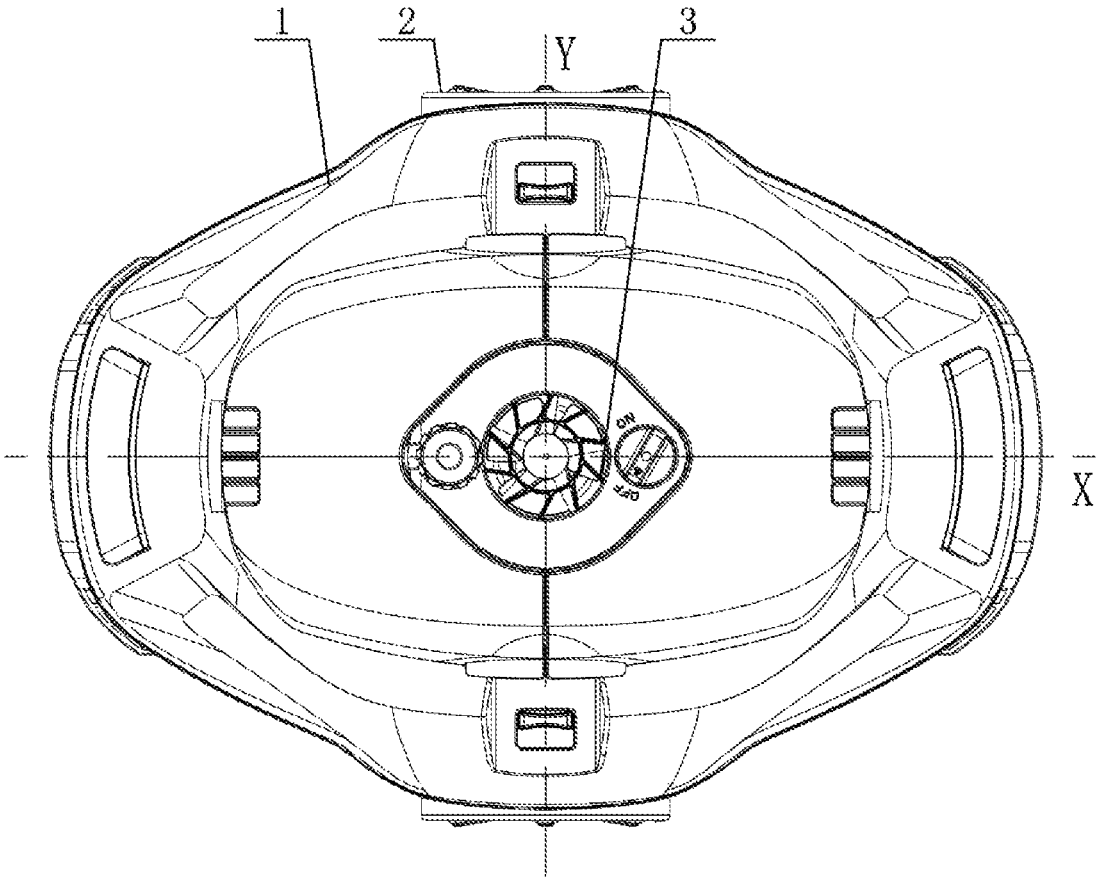
FIG. 1 is a structural diagram of the present disclosure.
Figure 2:
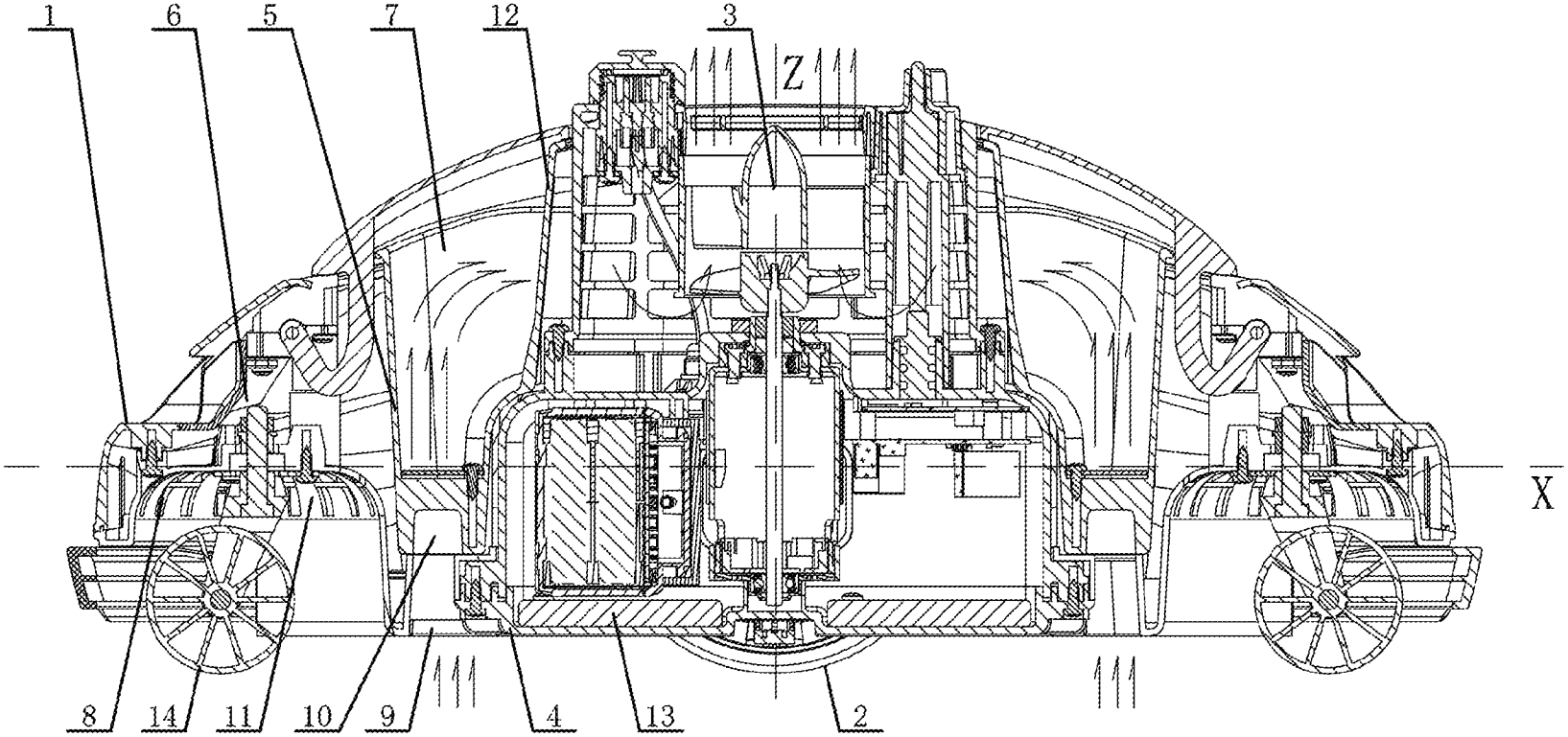
FIG. 2 is a sectional view of the present disclosure.
Figure 3:
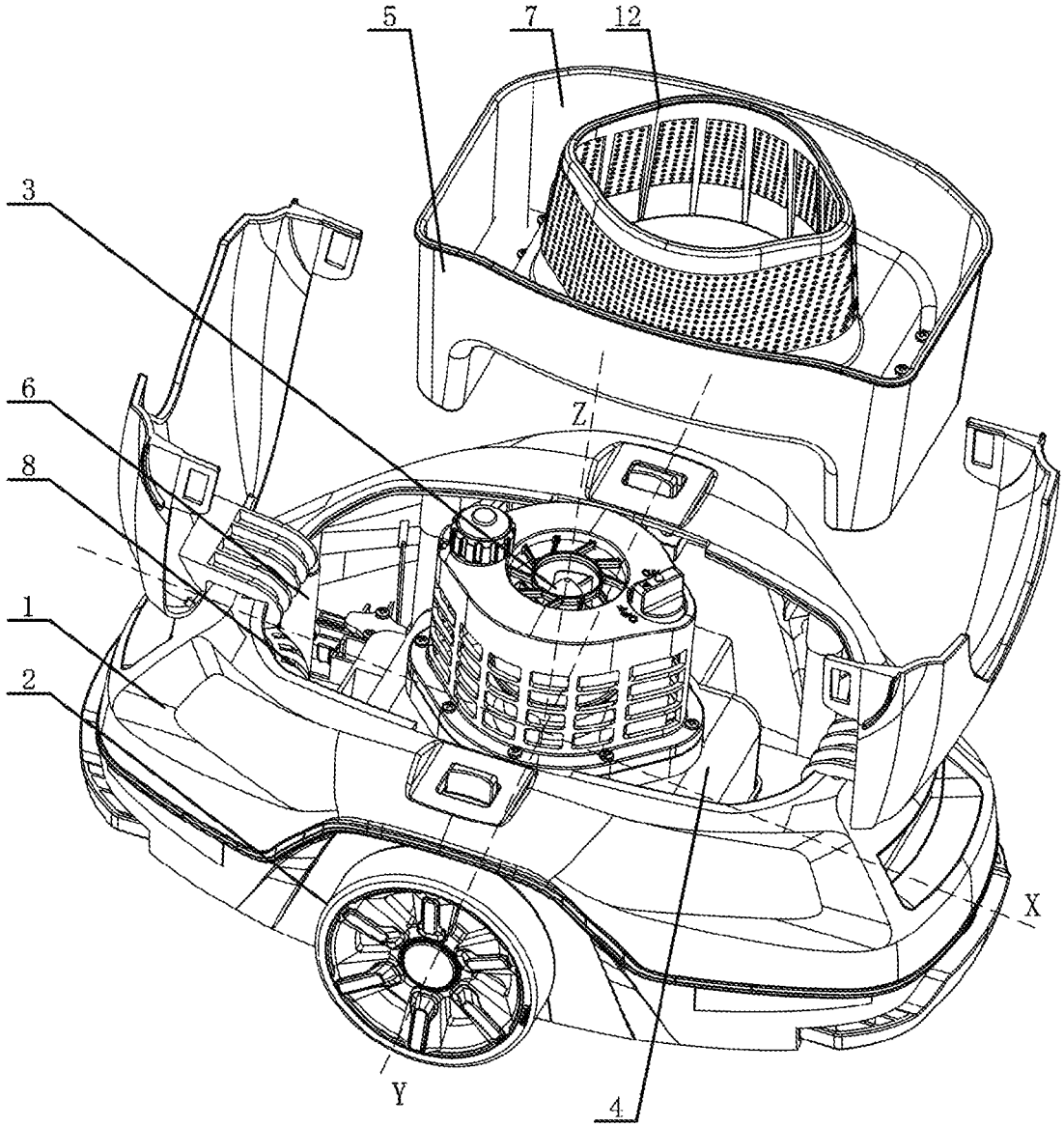
FIG. 3 is an exploded view of the present disclosure.
Figure 4:
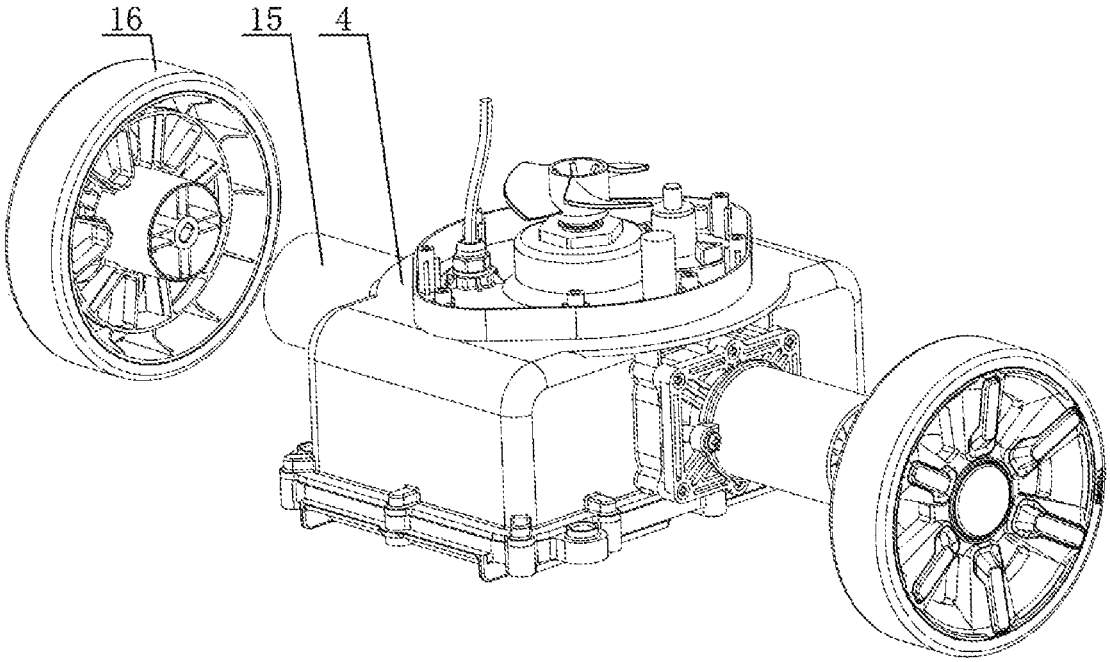
FIG. 4 is an exploded view of a driving wheel assembly in the present disclosure.
Figure 5:
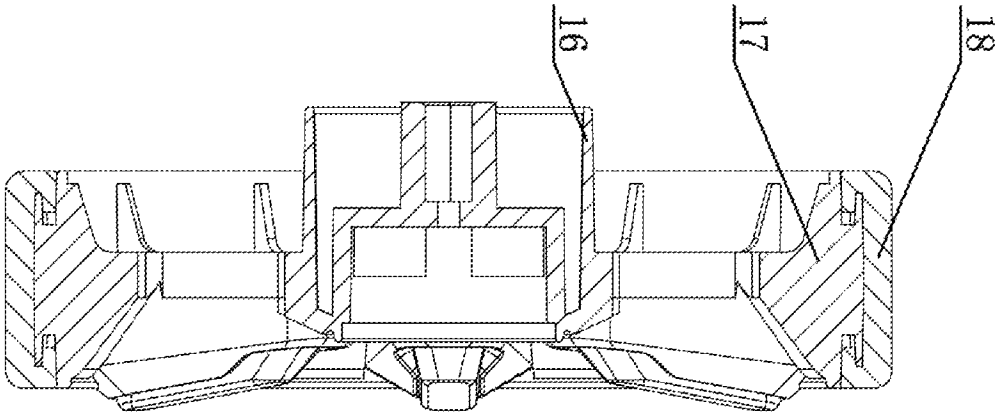
FIG. 5 is a sectional view of a wheel in the present disclosure.

As shown in FIG. 1 to FIG. 5, a posture stabilizing structure for a swimming pool sewage suction machine includes a base 1, a driving wheel assembly 2, a sealing box 4, a water pump assembly 3 and a collecting box 5, wherein the driving wheel assembly 2 is connected to the base 1, the water pump assembly 3 is arranged inside the base 1, the collecting box 5 is arranged inside the base 1 and communicated with the water pump assembly 3, and the swimming pool sewage suction machine has an X axis, a Y axis and a Z axis at a center along the length direction, width direction and height direction respectively, wherein the sealing box 4 is arranged on a middle part of a bottom of the base 1, the interior of the base 1 is divided into an inner ring water distribution bin 7 and an outer ring water distribution bin 6 through the collecting box 5, a gas-liquid circulation hole 8 is further defined in both a front end and a rear end of the bottom of the base 1 and communicated with the outer ring water distribution bin 6, a sewage inlet 9 is further defined on the base 1 at a position corresponding to the collecting box 5, a sewage suction opening 10 corresponding to the sewage inlet 9 is defined on a bottom of the collecting box 5, and the sewage suction opening 10 is communicated with the inner ring water distribution bin 7.

When the swimming pool sewage suction machine is ready to enter water, a user places the machine into water horizontally. During such process, since the bottom of the base 1 is provided with the gas-liquid circulation hole 8 and the sewage inlet 9, the air and water squeezed by the bottom of the base 1 will automatically and continuously enter the inner ring water distribution bin 7 and the outer ring water distribution bin 6 along the gas-liquid circulation hole 8, the sewage inlet 9 and the sewage suction opening 10, thereby accelerating the speed of the swimming pool sewage suction machine to enter water, reducing the reacting force of the water against the bottom of the base 1, and improving the stability of posture of the swimming pool sewage suction machine during the water entry course; in addition, since the sealing box 4 is arranged on the middle part of the bottom of the base 1, inside which sealing box 4 various control parts are generally gathered to be sealed against water, the arrangement of the position of the sealing box 4 makes the gravity center of the whole swimming pool sewage suction machine tend to the center of the base 1, further enhancing the stability of the swimming pool sewage suction machine during the water entry course and meanwhile enhancing the stability of the swimming pool sewage suction machine during the underwater walking course.

Preferably, a ratio of a sectional area of the sewage suction opening 10 to a sectional area of the gas-liquid circulation hole 8 is 1.2:1.

Preferably, a diversion bin 11 is further provided on the base 1 at the gas-liquid circulation hole 8.

Preferably, the diversion bin 11 is in the shape of a cover body with an opening downward and the projection of the diversion bin 11 in the height direction of the swimming pool sewage suction machine is on the X axis.

Preferably, the gas-liquid circulation holes 8 are distributed on the diversion bin 11 in an annular array.

Preferably, the water pump assembly 3 is connected to a middle part of an upper surface of the sealing box 4, the inner ring water distribution bin 7 is annular, and a middle part of the collecting box 5 is provided with an up-down through annular docking base 12, through which the collecting box 5 is sleeved on the water pump assembly 3.

Preferably, the collecting box 5 is provided to be symmetrical with the X axis and Y axis as center lines.

Preferably, a counterweight 13 is further arranged inside the sealing box 4 and the counterweight 13 is provided to be symmetrical in front and rear with the Y axis as a center line.

Preferably, the posture stabilizing structure further includes a universal wheel 14, wherein the number of the universal wheel 14 is two and they are connected to the front end and the rear end of the bottom of the base 1 respectively, the projection of the universal wheel 14 in the height direction of the swimming pool sewage suction machine is on the X axis, there are two driving wheel assemblies 2 and they are connected to middle parts of left and right side surfaces of the sealing box 4 respectively, and the projection of the driving wheel assembly 2 in the height direction of the swimming pool sewage suction machine is on the Y axis.

Preferably, a distance between a center of the universal wheel 14 and a center plane of the sealing box 4 is 120 mm.

Preferably, the sealing box 4 is positioned at an intersection of the X axis, the Y axis and the Z axis.

Preferably, the driving wheel assembly 2 includes a drive motor 15 and a wheel 16, and a surface of the wheel 16 is provided with rigid rubber 17 and soft rubber 18 from inside out in turn.

More specifically, during the water entry course, on one hand, air and water currents under the gathering function of the diversion bin 11 will automatically flow toward the gas-liquid circulation holes 8 and then flow into the outer ring water distribution bin 6; since the gas-liquid circulation holes 8 are distributed on the diversion bin 11 in an annular array, the water currents can enter the gas-liquid circulation holes 8 more smoothly; on the other hand, air and water currents will flow into the inner ring water distribution bin 7 along the sewage inlet 9 and the sewage suction opening 10, accelerating the speed of the swimming pool sewage suction machine to enter water.

During the water entry course, since the inner ring water distribution bin 7 is annular and the annular docking base 12 on the middle part of the collecting box 5 is sleeved on the water pump assembly 3 and the water pump assembly 3 is further connected to the middle part of the upper surface of the sealing box, the water entering the inner ring water distribution bin 7 will always rise around the water pump assembly 3 at the center of the base 1, moreover, since the sectional area of the sewage suction opening 10 is greater than the sectional area of the gas-liquid circulation hole 8, the volume entering the inner ring water distribution bin 7 is greater than that entering the outer ring water distribution bin 6; therefore, the center of gravity of the whole swimming pool sewage suction machine can be kept stable during the course of the machine entering water. In addition, the sealing box 4 is arranged on the middle part of the bottom of the base 1, the water pump assembly 3 is connected to the middle part of the upper surface of the sealing box 4, the counterweight 13 is further arranged inside the sealing box 4 and the counterweight 13 is provided to be symmetrical in front and rear with the Y axis as a center line, and the driving wheel assemblies 2 are connected to middle parts of left and right side surfaces of the sealing box 4, all of which together enhance greatly the gravity center anchoring function of the sealing box 4, so that the gravity center of the whole machine tends to the center of the machine, further improving the stability of posture of the swimming pool sewage suction machine during the water entry course, and enhancing the stability of posture of the swimming pool sewage suction machine during the underwater walking course.

Embodiment 2

A ratio of a sectional area of the sewage suction opening 10 to a sectional area of the gas-liquid circulation hole 8 is 1.8:1.

A distance between a center of the universal wheel 14 and a center plane of the sealing box 4 is 200 mm.

Other implementations are the same as Embodiment 1.

Embodiment 3

A ratio of a sectional area of the sewage suction opening 10 to a sectional area of the gas-liquid circulation hole 8 is 1.5:1.

A distance between a center of the universal wheel 14 and a center plane of the sealing box 4 is 160 mm.

Other implementations are the same as Embodiment 1.

To sum up, the above are preferred embodiments of the present disclosure. Any equivalent changes and modifications made according to the scope of patent of this application are intended to be covered in the scope of the present disclosure.

What is claimed is:

1. A posture stabilizing structure for a swimming pool sewage suction machine, comprising a base, a driving wheel assembly, a sealing box, a water pump assembly and a collecting box, wherein the driving wheel assembly is connected to the base (1), the water pump assembly is arranged inside the base, the collecting box is arranged inside the base and communicated with the water pump assembly, wherein the sealing box is arranged on a middle part of a bottom of the base, the interior of the base is divided into an inner ring water distribution bin and an outer ring water distribution bin through the collecting box, a gas-liquid circulation hole is further defined in both a front end and a rear end of the bottom of the base and communicated with the outer ring water distribution bin, a sewage inlet is further defined on the base at a position corresponding to the collecting box, a sewage suction opening corresponding to the sewage inlet is defined on a bottom of the collecting box, and the sewage suction opening is communicated with the inner ring water distribution bin.

2. The posture stabilizing structure for the swimming pool sewage suction machine according to claim 1, wherein a ratio of a sectional area of the sewage suction opening to a sectional area of the gas-liquid circulation hole is 1.2:1~1.8:1.

3. The posture stabilizing structure for the swimming pool sewage suction machine according to claim 1, wherein a diversion bin is further provided on the base at the gas-liquid circulation hole.

4. The posture stabilizing structure for the swimming pool sewage suction machine according to claim 3, wherein the diversion bin is in the shape of a cover body with an opening downward and the projection of the diversion bin in the height direction of the swimming pool sewage suction machine is on the X axis.

5. The posture stabilizing structure for the swimming pool sewage suction machine according to claim 3, wherein the gas-liquid circulation holes are distributed on the diversion bin in an annular array.

6. The posture stabilizing structure for the swimming pool sewage suction machine according to claim 1, wherein the water pump assembly is connected to a middle part of an upper surface of the sealing box, the inner ring water distribution bin is annular, and a middle part of the collecting box is provided with an up-down through annular docking base, through which the collecting box is sleeved on the water pump assembly.

7. The posture stabilizing structure for the swimming pool sewage suction machine according to claim 1, wherein the collecting box is provided to be symmetrical with the X axis and Y axis as center lines.

8. The posture stabilizing structure for the swimming pool sewage suction machine according to claim 1, wherein a counterweight is further arranged inside the sealing box and the counterweight is provided to be symmetrical in front and rear with the Y axis as a center line.

9. The posture stabilizing structure for the swimming pool sewage suction machine according to claim 1, further comprising a universal wheel, wherein the number of the universal wheel is two and they are connected to the front end and the rear end of the bottom of the base respectively, the projection of the universal wheel in the height direction of the swimming pool sewage suction machine is on the X axis, there are two driving wheel assemblies and they are connected to middle parts of left and right side surfaces of the sealing box respectively, and the projection of the driving wheel assembly in the height direction of the swimming pool sewage suction machine is on the Y axis.

10. The posture stabilizing structure for the swimming pool sewage suction machine according to claim 9, wherein a distance between a center of the universal wheel and a center plane of the sealing box is 120 mm-200 mm.

11. The posture stabilizing structure for the swimming pool sewage suction machine according to claim 1, wherein the sealing box is positioned at an intersection of the X axis, the Y axis and the Z axis.

12. The posture stabilizing structure for the swimming pool sewage suction machine according to claim 1, wherein the driving wheel assembly comprises a drive motor and a wheel, and a surface of the wheel is provided with rigid rubber and soft rubber from inside out in turn.

* * * * *